US009963918B2

(12) United States Patent
Chang

(10) Patent No.: US 9,963,918 B2
(45) Date of Patent: May 8, 2018

(54) HUMANIZED CONVENIENT DOOR LOCK

(71) Applicant: Dongguan Dazhan Metal Co., Ltd., Dongguan (CN)

(72) Inventor: Tung-Ming Chang, Dongguan (CN)

(73) Assignee: DONGGUAN DAZHAN METAL CO., LTD., Dongguan, Guangdong (CN)

( * ) Notice: Subject to any disclaimer, the term of this patent is extended or adjusted under 35 U.S.C. 154(b) by 253 days.

(21) Appl. No.: 14/853,951

(22) Filed: Sep. 14, 2015

(65) Prior Publication Data

US 2017/0074011 A1 Mar. 16, 2017

(51) Int. Cl.

| | |
|---|---|
| ***E05C 19/10*** | (2006.01) |
| ***E05C 3/14*** | (2006.01) |
| ***E05C 9/08*** | (2006.01) |
| ***E05C 9/00*** | (2006.01) |
| ***E05C 9/10*** | (2006.01) |
| ***E05C 3/12*** | (2006.01) |
| ***E05B 63/00*** | (2006.01) |

(52) U.S. Cl.

CPC ..... *E05C 3/145* (2013.01); *E05B 63/0004* (2013.01); *E05C 3/12* (2013.01); *E05C 9/006* (2013.01); *E05C 9/08* (2013.01); *E05C 9/10* (2013.01)

(58) Field of Classification Search

CPC ..... E05B 63/16; E05B 65/0811; E05B 2001/0076; E05B 55/00

USPC ..... 292/129

See application file for complete search history.

(56) References Cited

U.S. PATENT DOCUMENTS 4,118,056 A * 10/1978 Alexander ..... E05B 59/00 292/169

4,674,776 A * 6/1987 James ..... E05B 13/004 292/150

* cited by examiner

*Primary Examiner* — Mark A Williams

(74) *Attorney, Agent, or Firm* — Leong C. Lei

(57) ABSTRACT

A humanized convenient door lock includes a lock housing, a latch, a security hook, an outside handle operation mechanism, an inside handle operation mechanism, a cylinder driving mechanism, and an inside deadlocking rotary knob driving mechanism. The inside handle operation mechanism drives and controls the latch, the security hook, and the inside deadlocking rotary knob driving mechanism. To open the door, it only needs a one-time operation by pressing down a handle, thereby providing ease and convenience. The design is a humanized one, making it particularly suit for the needs of the disabled and the elderly and for urgent door opening.

2 Claims, 5 Drawing Sheets

HUMANIZED CONVENIENT DOOR LOCK

TECHNICAL FIELD OF THE INVENTION

The present invention relates generally to the field of door locks, and more particularly to a humanized convenient door lock.

DESCRIPTION OF THE PRIOR ART

Some of the currently available door locks include a latch and a deadlocking mechanism that enable deadlocking from the indoor side. Thus, in daily living, to open a door, it often needs to first operate a rotary knob for the deadlocking and the rotate a door handle on the indoor side to eventual release the door for opening. Although a door lock with a deadlocking function helps improve door security, the operation is surely complicated and this is even worse for people holding objects with hands to open the door. Further, this is always a trouble for young kids, the aged people, and the disabled.

Thus, it is desired to have an innovated technique to overcome such a problem

SUMMARY OF THE INVENTION

Thus, in light of the above, the present invention, as a primary object thereof, aims to provide a humanized convenient door lock, which is made to overcome the drawbacks and shortcomings found in the prior art devices, by allowing a door to be opened by directly operating a door handle for just one time without the need of first operating the deadlocking knob as required in the prior art devices, thereby providing convenience to the users and making the design thereof more humanized.

To achieve the above object, the present invention adopt the following technical solution:

A humanized convenient door lock comprises a lock housing (2), a latch (28), a security hook (7), an outside handle operation mechanism, an inside handle operation mechanism, a cylinder driving mechanism, and an inside deadlocking rotary knob driving mechanism, wherein the outside handle operation mechanism and the inside handle operation mechanism are structured to be independent of each other and not in driving coupling with each other; the cylinder driving mechanism and the inside deadlocking rotary knob driving mechanism are structured to be independent of each other and not in driving coupling with each other; and the inside handle operation mechanism simultaneously controls the latch (28), the security hook (7), and the inside deadlocking rotary knob driving mechanism.

Compared to the prior art, the present invention shows significant advantages and beneficial efficacies. Specifically, it can be known from the above-described technical solution that the general feature is that the inside handle operation mechanism controls, simultaneously, the latch, the security hook, and the inside deadlocking rotary knob driving mechanism. To open a door, it does not need to first take an operation to release the rotary knob for deadlocking and it only needs to press down a handle to complete, with a one-time operation, opening of the door. This provides ease and convenience for the users and the design is a humanized one, making it particularly suit for the needs of the disable and the elderly and for urgent door opening. Further, compared to the conventional deadbolt based deadlocking structure, the security hook could have bettered constraint against movement in both leftward and rightward directions and frontward and rearward directions, making the door lock more secure and reliable.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
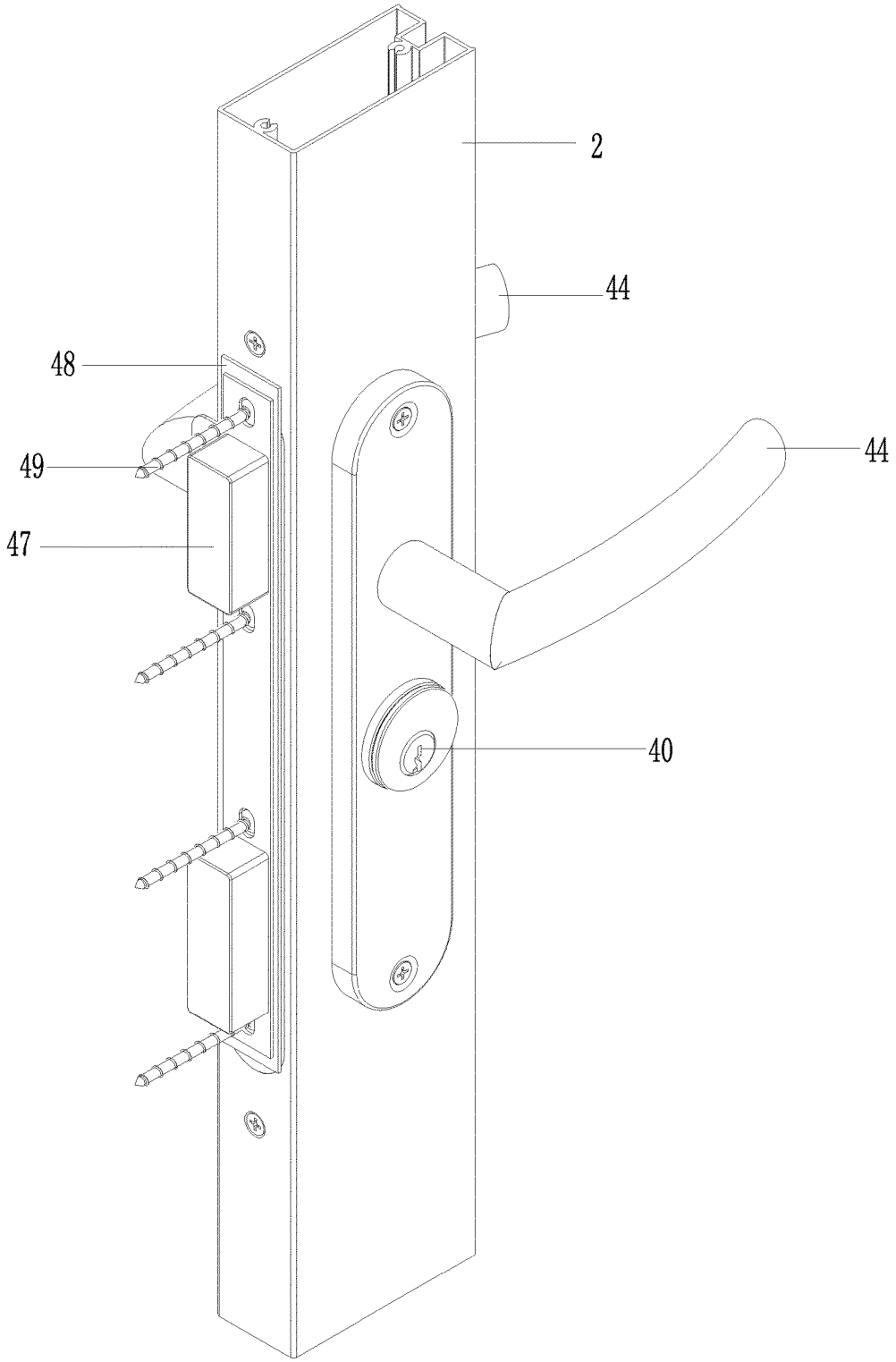
FIG. 1 is a perspective view showing an embodiment of the present invention.
Figure 2:
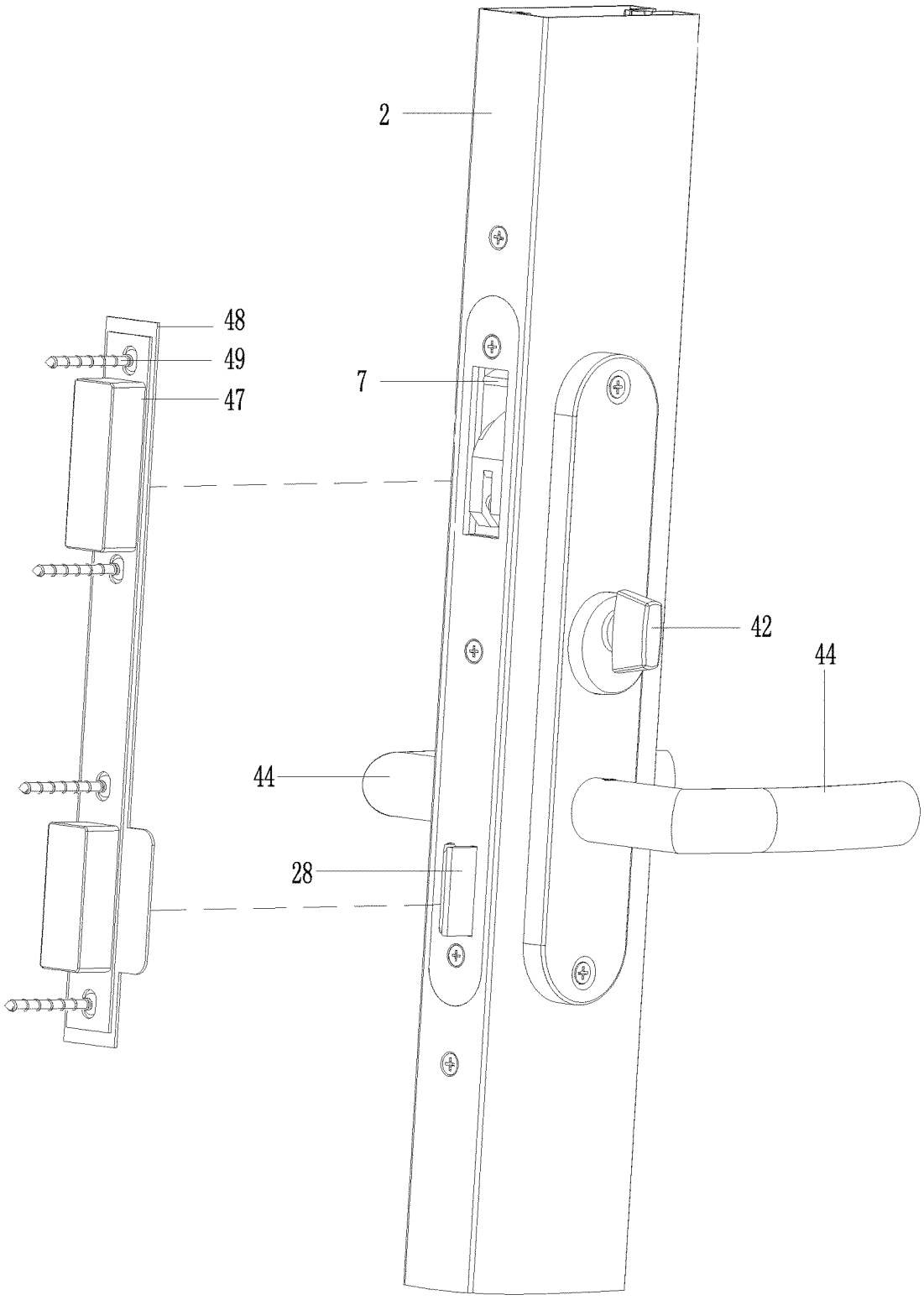
FIG. 2 is an exploded view of the embodiment of the present invention.
Figure 3:
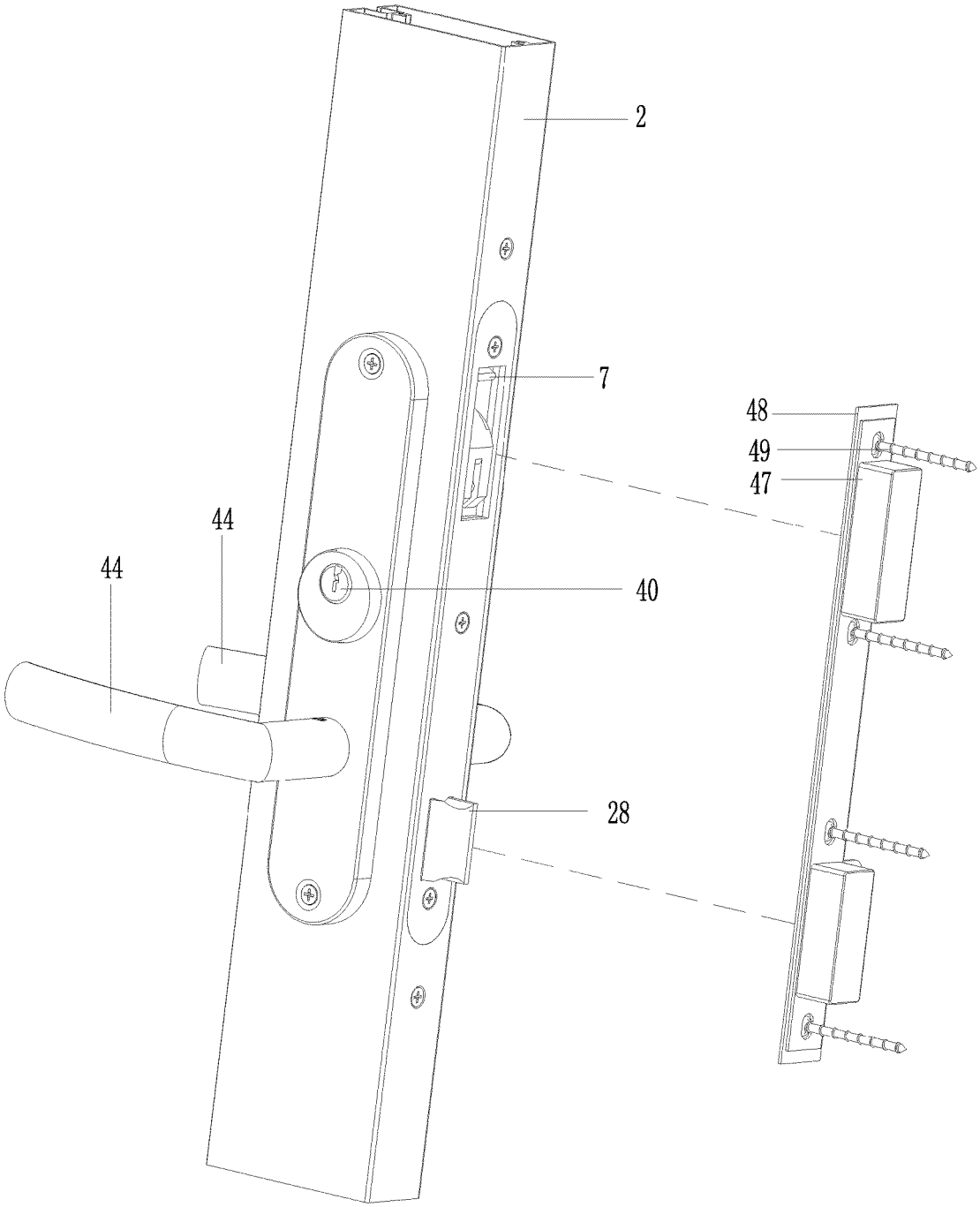
FIG. 3 shows another exploded view of FIG. 2 taken from a different perspective.
Figure 4:
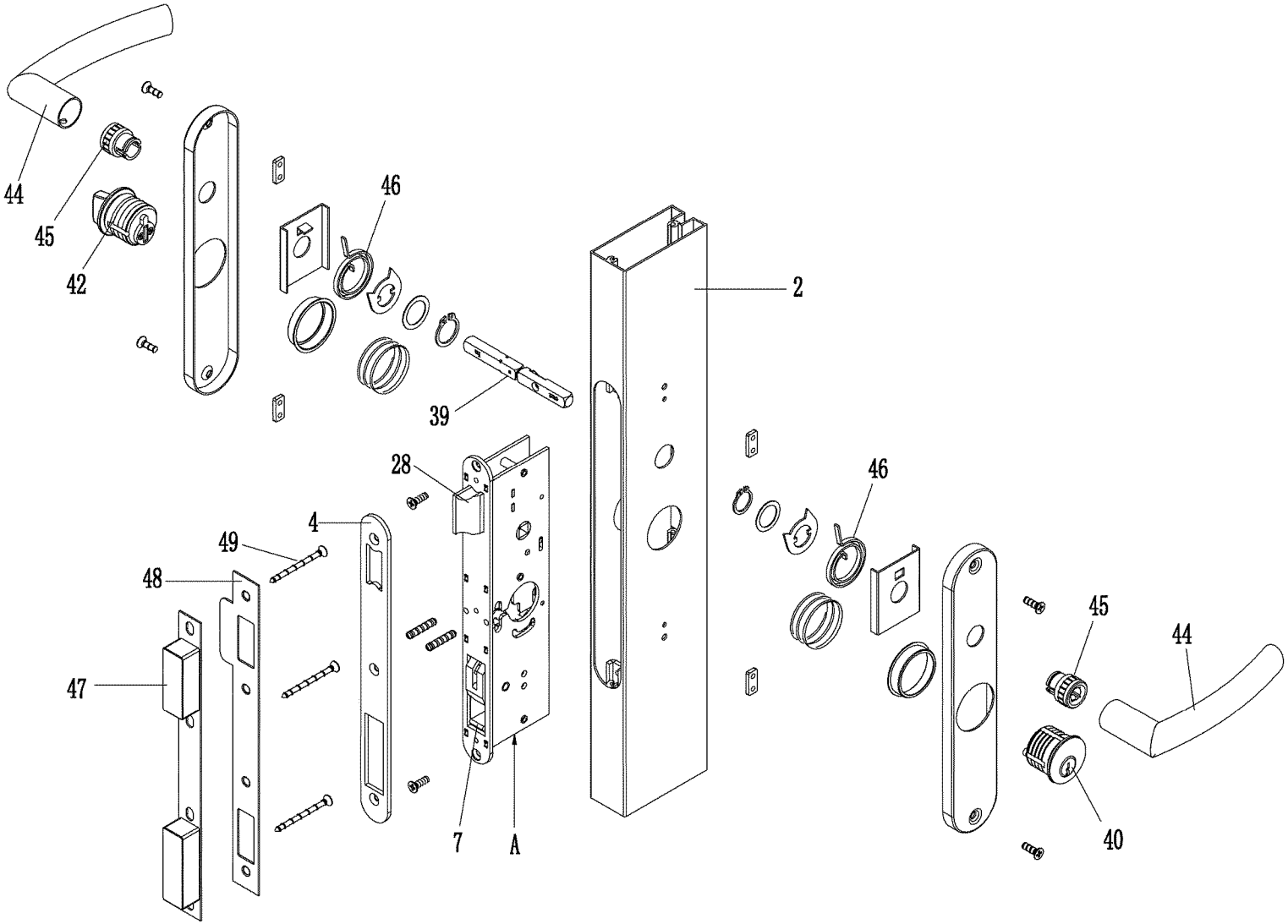
FIG. 4 is an exploded view, in a more detailed form, showing the embodiment of the present invention.
Figure 5:
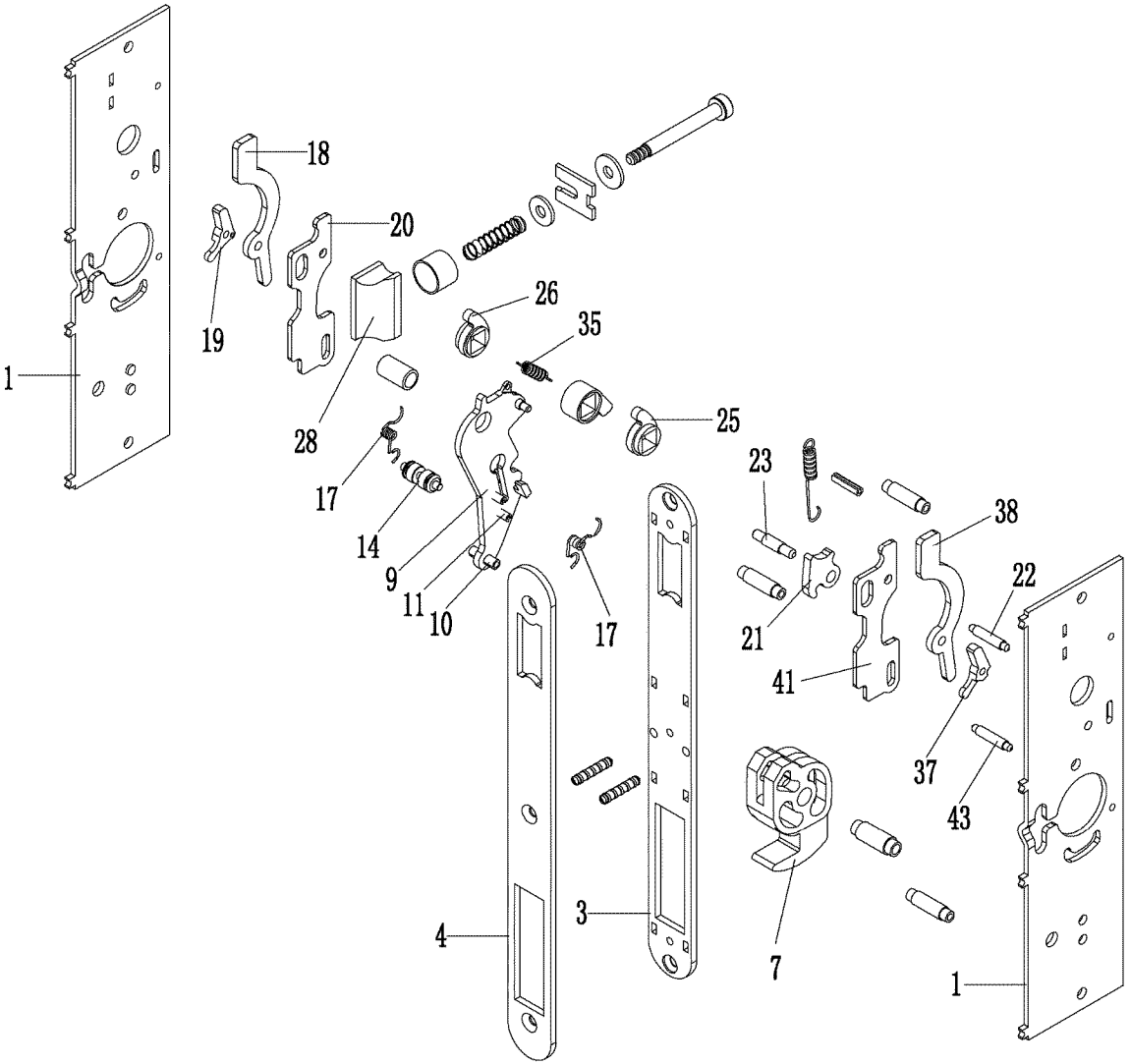
FIG. 5 is an exploded view of a module (designated at A) of the embodiment of the present invention.

Referring to FIGS. 1-5, a structure of an embodiment of the present invention is shown, which comprises two portions that are respectively mounted to a door frame and a door body and will be respectively referred to as "first portion" and "second portion" herein, wherein the first portion provides accommodation slots respectively corresponding to and for a latch (28) and a security hook (7) and, here, the first portion specifically comprises a plastic casing (47), a stainless steel plate (48) and mounting screws (49).

Next, description will be given to the structure of the second portion, which comprises a lock housing (2), a latch (28), a security hook (7), an outside handle operation mechanism, an inside handle operation mechanism, a cylinder driving mechanism, and an inside deadlocking rotary knob driving mechanism, wherein the outside handle operation mechanism and the inside handle operation mechanism are structures that are independent each other and are not inter-driving with each other and the cylinder driving mechanism and the inside deadlocking rotary knob driving mechanism are structures that are independent each other; and the inside handle operation mechanism simultaneously drives and controls the latch (28), the security hook (7), and the inside deadlocking rotary knob driving mechanism. In the instant embodiment, the driving mechanism is specifically designed for a cylindrical independent lock cylinder structure (such as a cylindrical independent lock cylinder available from Schlage), wherein the cylinder (40) that is exposed outside the outer side of the door to work with a key and the rotary knob (42) that is exposed inside the inner side of the door for deadlocking are two mutually independently controllable operation parts, of which the structure is apparently different from a coaxial driving type lock cylinder structure that is commonly used in China. Such a cylindrical independent lock cylinder structure is commonly used in European and American areas. Thus, the humanized convenient door lock according to the present invention is more suitable for use in European and American areas and the maintenance and replacement of the cylindrical independent lock cylinder is very easy and convenient.

The lock housing (2) is of a unitary chamber structure comprising a mounting chamber formed therein and a side surface facing the accommodation slots and comprising an opening formed therein to help mounting a module, which is designated with character A, and to allow the latch (28) and the security hook (7) of the module to expose and project outward therefrom. The module A is generally a primary part of the lock body and comprises an enclosure structure that is composed of a lock body fixing plate (3) and two (front and rear) cover plates (1) combined together in a circumferentially enclosing manner, wherein the lock body fixing plate (3) is provided, on the outside thereof, with a lock body fixing plate decoration plate (4). The lock body fixing plate (3) and the lock body fixing plate decoration plate (4) are each provided with two through holes through which the latch (28) and the security hook (7) respectively extend.

The outside handle operation mechanism comprises an outside handle assembly, an outside handle pull plate (25), and an outside handle driving plate (38), wherein the outside handle pull plate (25) is driven by rotation of the outside handle assembly to push the outside handle driving plate (38), and the outside handle driving plate (38) in turn drives the latch (28) to extend out and/or retract in. The inside handle operation mechanism comprises an inside handle assembly, an inside handle pull plate (26), and an inside handle driving plate (18), wherein the inside handle pull plate (26) is driven by the rotation of the outside handle assembly to push the inside handle driving plate (18), and the inside handle driving plate (18) in turn drives the latch (28) to extend out and/or retract in. In the instant embodiment, the latch (28) is installed and positioned by means of a positioning tube, a compression spring, washers, a positioning plate, and a bolt. The inside handle assembly and the outside handle assembly are coupled to each other with an arrangement of a handle axle (39). The inside handle assembly and the outside handle assembly are independently operable to rotate the handle axle (39) (and are not is driving connection with each other and thus, the handle axle (39) is not an axle for driving connection and provides a function of positioning and supporting. In the instant embodiment, the inside and outside handle assemblies both comprise a handle (44), a handle plug (45), a handle torsional spring (46), a handle torsional spring positioning plate, a grip positioning plate, a washer, and a retention ring and the likes.

The cylinder driving mechanism comprises the cylinder (40), a cylinder driving axle (14), a torsional spring (17), and a cylinder driving plate (9). The cylinder driving plate (9) is provided with a cylinder driving plate first axle (10), a cylinder driving plate first axle (11), a cylinder driving plate pull plate axle (23), cylinder driving plate pull plates (37), and a cylinder driving plate pull plate return spring (35). The cylinder (40) drives the cylinder driving axle (14). The torsional spring (17) has an end connected to the cylinder driving axle (14) and the torsional spring (17) has an opposite end connected to the cylinder driving plate (9). The cylinder driving plate (9) is acted upon by the torsional spring (17) to selectively rotate in such a way that the cylinder driving plate pull plate axle (23) thereof drives the first cylinder driving plate pull plate (37) and the second cylinder driving plate pull plate (19) to move. The cylinder driving plate pull plate (37) and the second cylinder driving plate pull plate (19), in turn, drive the outside handle driving plate (38) and the inside handle driving plate (18) that are respectively corresponding thereto in order to control the extension and retraction of the latch (28). At the same time, the cylinder driving plate (9) drives the security hook (7) to rotate in a direction for hooking or in an opposite direction for releasing.

The inside deadlocking rotary knob driving mechanism comprises a rotary knob (42), a first rotary knob pull plate (20), a second rotary knob pull plate (41), and a third rotary knob pull plate (21). The first rotary knob pull plate (20) and the second rotary knob pull plate (41) each have an end collectively and operatively coupled via a rotary knob pull plate axle (43) to the cylinder driving plate (9) and the first rotary knob pull plate (20) and the second rotary knob pull plate (41) each have an end collectively and operatively coupled via the inside handle driving plate axle (22) to the inside handle driving plate (18). The inside handle assembly is operable, via the driving coupling of the inside handle pull plate (26) and the inside handle driving plate (18), to drive the first rotary knob pull plate (20), the second rotary knob pull plate (41) and the third rotary knob pull plate (21), at the same time when driving the latch (28), and also driving the cylinder driving plate (9) to move the security hook (7). As such, door opening can be achieved through a one-time operation by simply pressing down the handle.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A convenient door lock, comprising a lock housing, a latch, a security hook, an outside handle operation mechanism, an inside handle operation mechanism, a cylinder driving mechanism, and an inside deadlocking rotary knob driving mechanism, wherein the outside handle operation mechanism and the inside handle operation mechanism are structured to be independent of each other and not in driving coupling with each other; the cylinder driving mechanism and the inside deadlocking rotary knob driving mechanism are structured to be independent of each other and not in driving coupling with each other; and the inside handle operation mechanism simultaneously controls the latch, the security hook, and the inside deadlocking rotary knob driving mechanism;

wherein the outside handle operation mechanism comprises an outside handle assembly, an outside handle pull plate, and an outside handle driving plate, the outside handle pull plate being driven by rotation of the outside handle assembly to push the outside handle driving plate, the outside handle driving plate driving the latch to selectively extend and retract; the inside handle operation mechanism comprises an inside handle assembly, an inside handle pull plate, and an inside handle driving plate, the inside handle pull plate being driven by rotation of the outside handle assembly to push the inside handle driving plate, the inside handle driving plate driving the latch to selectively extend and retract; and the inside handle assembly and the outside handle assembly are coupled to each other through a handle axle; the cylinder driving mechanism comprises a cylinder, a cylinder driving axle, a torsional spring, and a cylinder driving plate, the cylinder driving plate being provided with a cylinder driving plate first axle, a cylinder driving plate first axle, a cylinder driving plate pull plate axle, a cylinder driving plate pull plate, and a cylinder driving plate pull plate return spring; the cylinder drives the cylinder driving axle, the torsional spring having an end connected to the cylinder driving axle, the torsional spring having an opposite end connected to the cylinder driving plate, the cylinder driving plate being acted upon by the torsional spring to selectively rotate in such a way that the cylinder driving plate pull plate axle thereof drives the first cylinder driving plate pull plate and the second cylinder driving plate pull plate to move, and the cylinder driving plate pull plate and the second cylinder driving plate pull plate drive respectively the outside handle driving plate and the inside handle driving plate that are respectively corresponding thereto in order to control the extension and retraction of the latch; and at the same time, the cylinder driving plate drives the security hook to rotate in a direction for hooking or in an opposite direction for releasing; and the inside deadlocking rotary knob driving mechanism comprises a rotary knob, a first rotary knob pull plate, a second rotary knob pull plate, and a third rotary knob pull plate, the first rotary knob pull plate and the second rotary knob pull plate each having an end collectively and operatively coupled via a rotary knob pull plate axle to the cylinder driving plate, the first rotary knob pull plate and the second rotary knob pull plate each having an end collectively and operatively coupled via the inside handle driving plate axle to the inside handle driving plate, the inside handle assembly being operable, via the driving coupling of the inside handle pull plate and the inside handle driving plate, to drive the first rotary knob pull plate, the second rotary knob pull plate, and the third rotary knob pull plate at the same time when driving the latch, and also driving the cylinder driving plate to move the security hook.

2. The convenient door lock according to claim 1, wherein the inside and outside handle assemblies each comprise a handle, a handle plug, and a handle torsional spring.

* * * * *